US006796874B2

(12) United States Patent
Harada

(10) Patent No.: US 6,796,874 B2
(45) Date of Patent: Sep. 28, 2004

(54) TOY VEHICLE WITH SHOCK ABSORBING STEERING MECHANISM

(75) Inventor: Katsuyoshi Harada, Tokyo (JP)

(73) Assignee: Nikko Co., Ltd., Tokyo (JP)

( * ) Notice: Subject to any disclaimer, the term of this patent is extended or adjusted under 35 U.S.C. 154(b) by 332 days.

(21) Appl. No.: 09/842,142

(22) Filed: Apr. 26, 2001

(65) Prior Publication Data

US 2001/0053653 A1 Dec. 20, 2001

(30) Foreign Application Priority Data

Jun. 15, 2000 (JP) ..... 2000-180631

(51) Int. Cl.[7] ..... A63H 17/36
(52) U.S. Cl. ..... 446/468; 446/460; 446/454
(58) Field of Search ..... 446/460, 457, 446/458, 459, 465, 466, 454, 468, 469; 267/166–180; 188/166–167

(56) References Cited

U.S. PATENT DOCUMENTS

| | | | | | |
|---|---|---|---|---|---|
| 2,757,028 | A | * | 7/1956 | Latzen | 280/93.511 |
| 3,635,304 | A | * | 1/1972 | Hills | 180/400 |
| 3,848,885 | A | * | 11/1974 | Hefren | 267/150 |
| 3,853,069 | A | * | 12/1974 | Goodwin | 104/245 |
| 4,146,109 | A | * | 3/1979 | Barth | 180/420 |
| 4,171,592 | A | | 10/1979 | Saitoh | |
| 5,000,716 | A | | 3/1991 | Canavesi | |
| 5,104,136 | A | * | 4/1992 | Buhl et al. | 188/371 |
| 5,338,246 | A | * | 8/1994 | Suto | 446/466 |
| 5,383,675 | A | * | 1/1995 | Liebert | 114/144 R |
| 5,709,583 | A | * | 1/1998 | Suto et al. | 446/440 |
| 5,722,673 | A | * | 3/1998 | Mauz | 280/124.132 |

FOREIGN PATENT DOCUMENTS

| | | |
|---|---|---|
| DE | 1 902 231 | 7/1970 |
| DE | 39 12 545 A1 | 12/1989 |
| FR | 2 443 263 | 7/1980 |
| JP | 5-253356 | 10/1993 |
| JP | 5-329274 | 12/1993 |
| JP | 8-230709 | 9/1996 |
| JP | 9-286215 | 11/1997 |

* cited by examiner

*Primary Examiner*—Jessica Harrison
*Assistant Examiner*—Alex F. R. P. Rada, II
(74) *Attorney, Agent, or Firm*—Young & Thompson

(57) ABSTRACT

A remote control running toy comprises a pair of uprights (24), each having a kingpin (22) for steerably supporting the wheels (20); and a steering mechanism (32) which is coupled through steering rods (30) with the uprights (24); wherein the running toy comprises a coil-shaped spring member (40) for absorbing a shock transmitted via the uprights (22) to the steering rods (28). Thereby, the remote control running toy is provided, which is able to prevent the steering rods from being damaged, even if a strong shock acts onto the front wheels, thus improving the reliability of the running toy.

2 Claims, 4 Drawing Sheets

TOY VEHICLE WITH SHOCK ABSORBING STEERING MECHANISM

BACKGROUND OF THE INVENTION

The present invention relates to a remote control running toy which is operated by a remote controller.

As shown in FIG. 1, the remote control running toy of the conventional type is generally provided with a suspended chassis 14 on which a car body mounts, a pair of right and left uprights 24, each having a kingpin 22 for steerably supporting a pair of right and left front wheels 20 fitted at the front of the chassis 14, a pair of right and left upright holders 26 connected through the right and left uprights 24 to the right and left front wheels 20, and a pair of supporting shafts 28 for pivotably supporting the right and left upright holders 26 so as to allow the uprights 24 to move up and down in accordance with the displacement of the center of front wheels 20 upwardly and downwardly relative to the chassis 14, wherein the right and left uprights 24 are coupled through one end of each steering rod 30 with a steering mechanism 32. This steering mechanism 32 disposed on the chassis 14 is provided with a driving motor 38 for driving a disc-shaped cam 34 fixedly mounted on a shaft 36 of the motor 38, the cam 34 being coupled with another end of each steering rod 30, thereby causing the steering rods 30 to move in lateral directions perpendicular to a longitudinal direction of the chassis 14 as the cam 34 is rotated by the motor 38. As the result, the running direction of the front wheels 20 is controlled by the steering mechanism 32.

However, the remote control running toy of the conventional type has a drawback that when the front wheels are happened to be collided against an obstacle during the driving of the running toy, the impact force produced by the collision is transmitted through the uprights to the steering rods, causing damages to the steering rods or the steering mechanism.

SUMMARY OF THE INVENTION

The present invention has been done in view of solving the drawback, and therefore, an object of the present invention is to provide a remote control running toy capable of avoiding the damages from being damaged, even if a strong shock acts onto the front wheels, thereby improving the reliability of the running toy.

To achieve the above objects, the present invention provides a remote control running toy comprising: a suspended chassis on which a car body mounts; a rear-wheel driving mechanism for running the chassis by driving a pair of right and left rear wheels fitted respectively at the right and left rear sides of the chassis; a pair of uprights, each having a kingpin for steerably supporting a pair of right and left front wheels fitted respectively at the right and left front sides of the chassis; and a steering mechanism coupled through steering rods with the uprights; wherein the running toy is provided with a shock absorber for absorbing a shock transmitted through the uprights to the steering rods Preferably, the shock-absorber is a coil-shaped spring member formed by winding up a part of the steering rods made of a metal wire in a coil-like form.

DETAILED DESCRIPTION OF THE PREFERRED EMBODIMENTS

Hereinafter, one embodiment of the remote control running toy according to the present invention will be described with reference to FIGS. 2 to 4.

Figure 1:
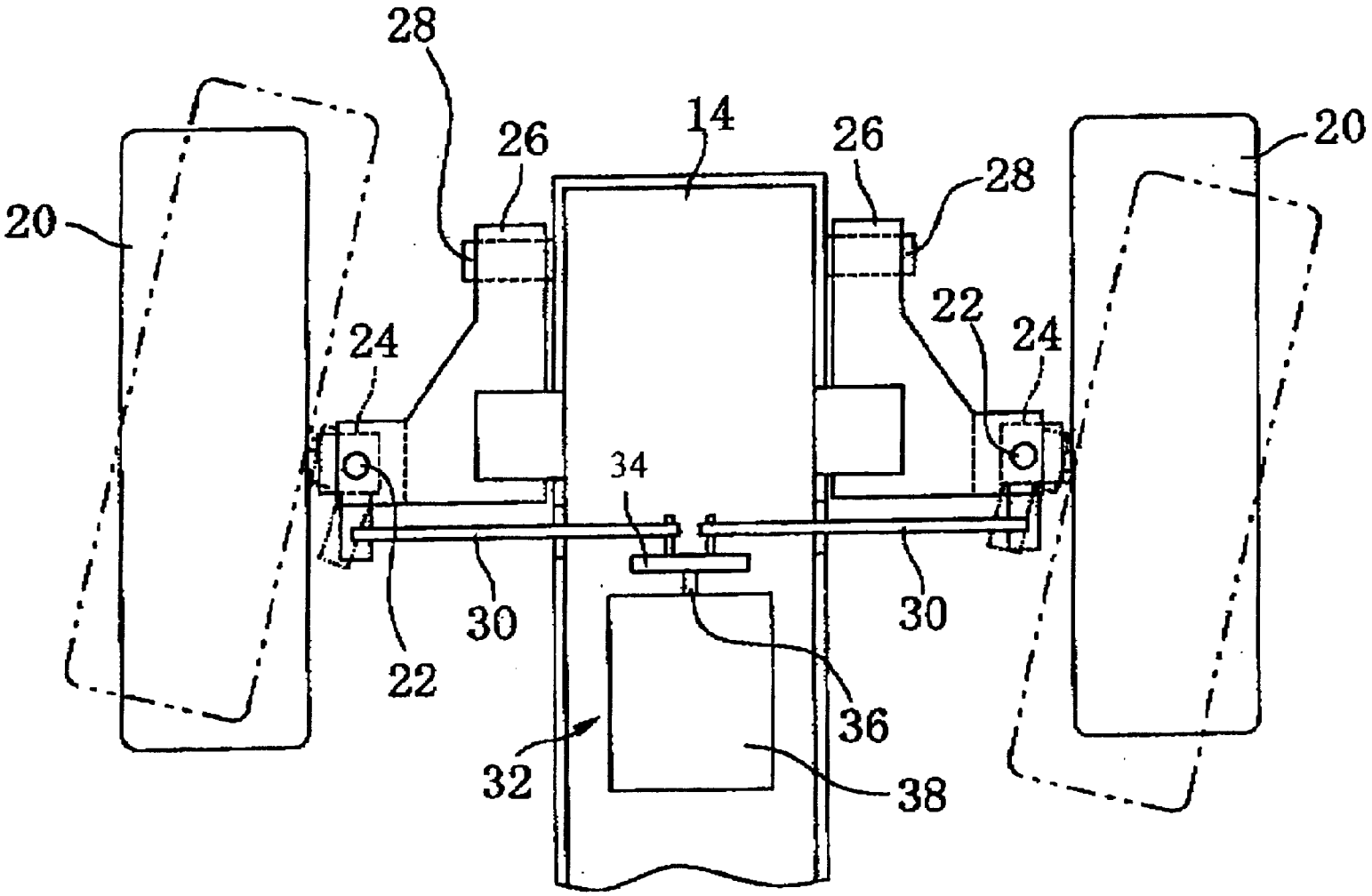
FIG. 1 Prior art
FIG. 1 is a plan view illustrating the conventional remote control running toy.
Figure 2:
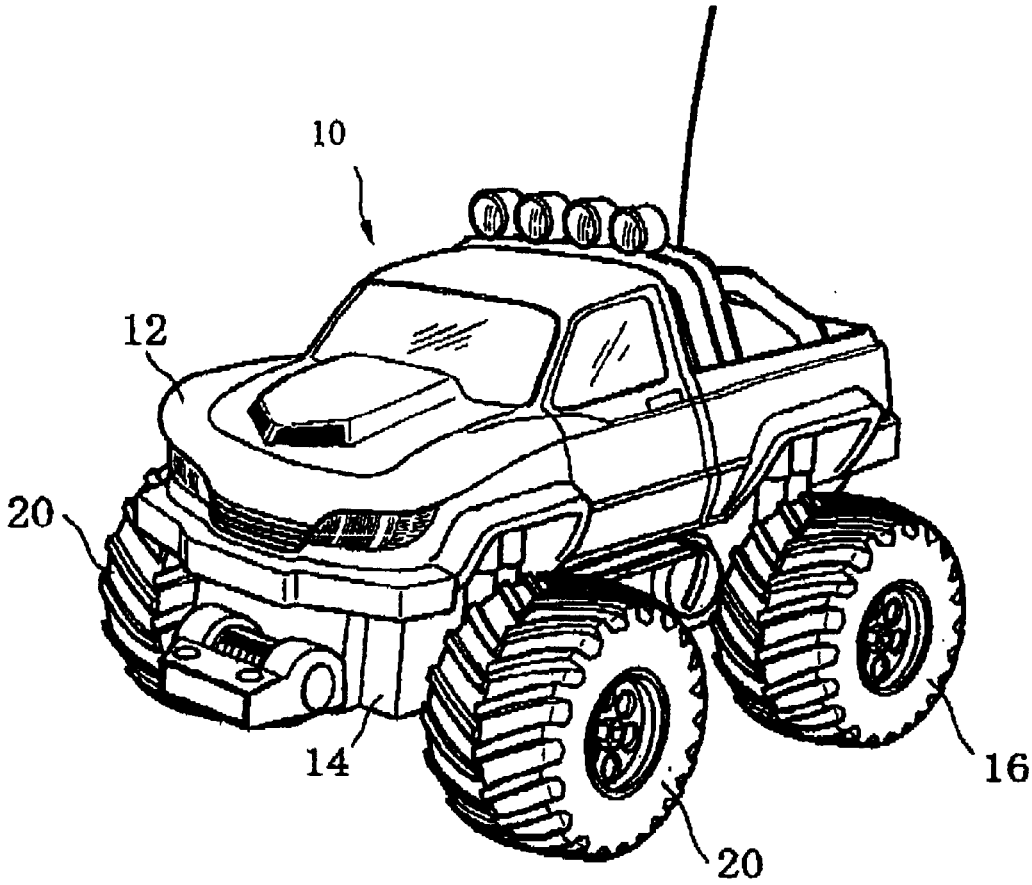
FIG. 2 is a perspective view illustrating a remote control running toy according to one embodiment of the present invention.
Figure 3:
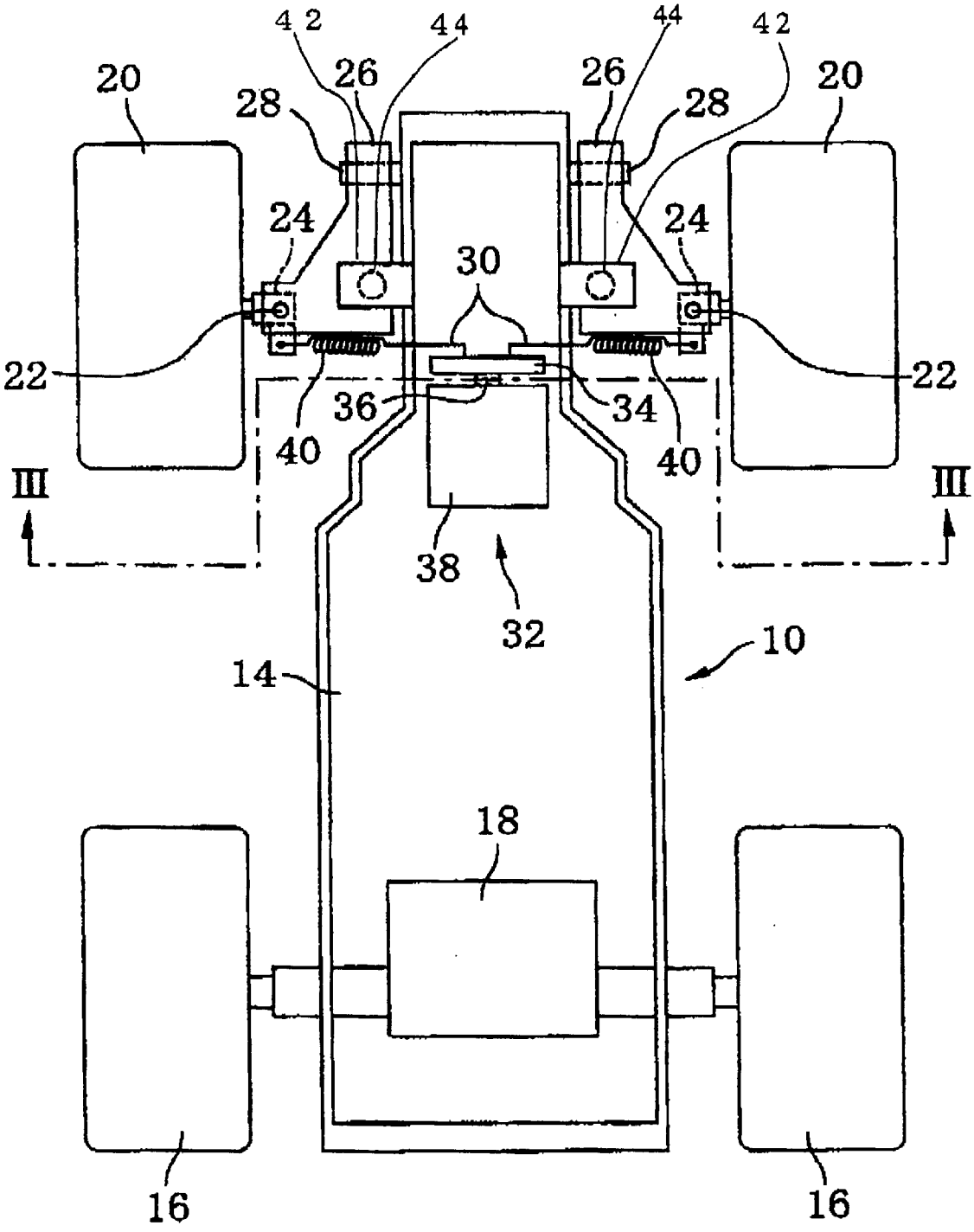
FIG. 3 is a schematic plan view illustrating the remote control running toy shown in FIG. 2.
Figure 4:
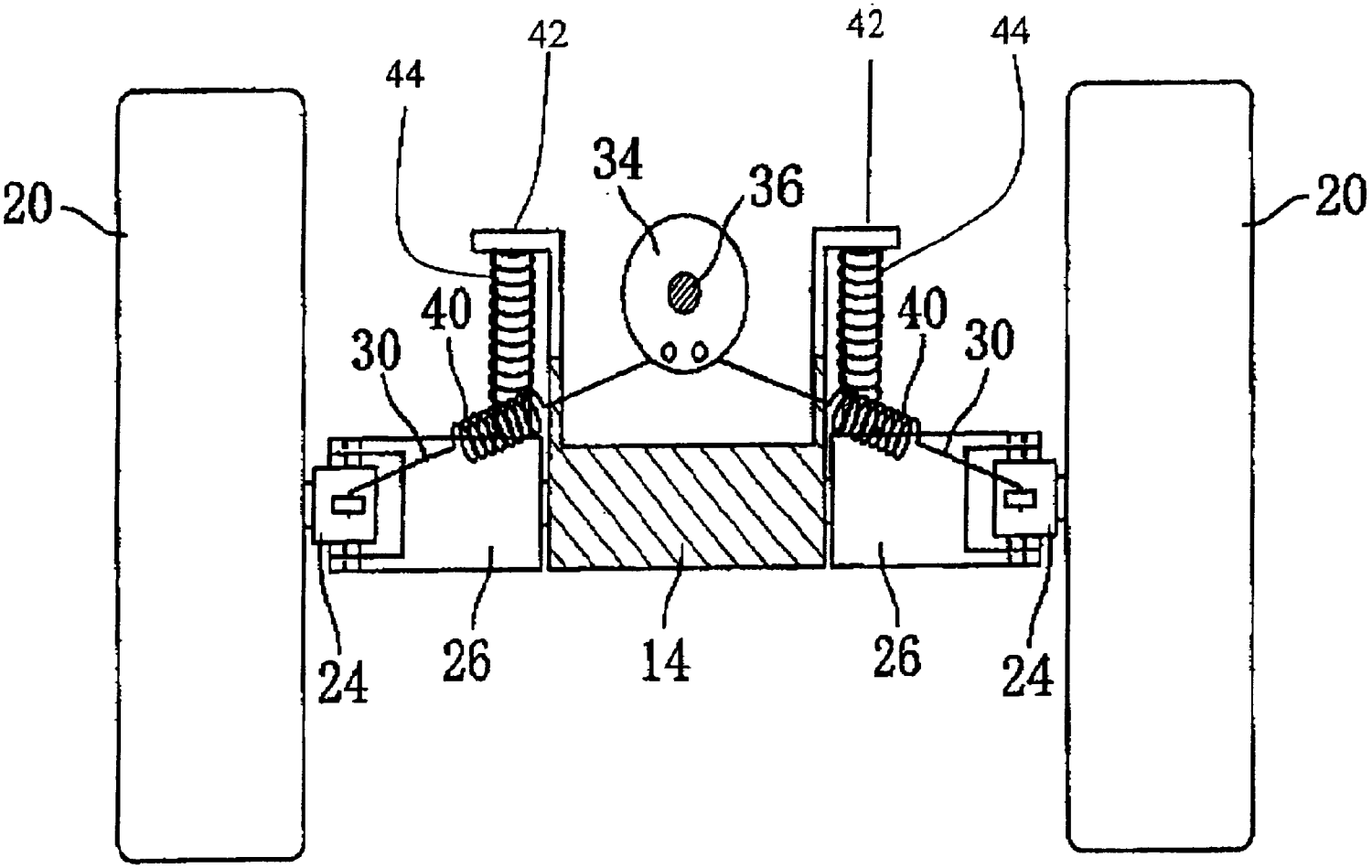
FIG. 4 is a cross-sectional view taken along a III—III line of FIG. 3.

Referring to FIGS. 2 and 3, the remote control running toy 10 according to one embodiment of the present invention is provided with a suspended chassis 14 on which a car body 12 mounts; a pair of right and left rear-wheels 16 for drivably supporting a rear of the chassis 14; and a rear-wheel driving mechanism 18 for driving the rear-wheels 16.

The remote control running toy 10 comprises: a pair of right and left front-wheels 20 for drivably supporting a front of the chassis 14; a pair of uprights 24, each having a kingpin 22 for steerably supporting the right and left front wheels 20; a pair of right and left upright holders 26 connected through the right and left uprights 24 to the right and left front wheels 20, and a pair of supporting shaft 28 for pivotably supporting the right and left upright holders 26 so as to allow the uprights 24 to move up and down in accordance with the displacement of the center of the front wheels 20 upwardly or downwardly relative to the chassis 14, wherein the right and left uprights 24 are coupled through first ends of steering rods 30 to a steering mechanism 32. A pair of suspensions 44 is mounted on the pair upright holders 26. A pair of support members 42 extends upwardly from opposite sides of the chassis 14. The support members 42 are fixed to the tops of the suspensions 44, so that the chassis 14 is indirectly suspended by the suspensions 44.

As shown in FIG. 3, the steering mechanism 32 is provided on the chassis 14. The steering mechanism has a driving motor 38 with a shaft 36, on which a disc-shaped cam 34 is placed, the cam 34 being coupled with second ends of the steering rods 30, thereby causing the steering rods 30 to move in lateral directions perpendicular to a longitudinal direction of the chassis 14 as the cam 34 is rotated by the motor 38, and as the result, the running direction of the front wheels 20 is controlled by the steering mechanism 32.

The steering rod 30 and the coil-shaped spring member 40 are unitary formed by a single metal wire. The coil-shaped spring member 40 serves as a shock absorber.

In the embodiment according to the present invention, when either one of the front wheels 20 is collided against an obstacle, the impact force produced by this collision is transmitted through the upright 24 to the steering rods 30, resulting in elastic deformations of the coil-shaped spring members 40, thus absorbing the impact force. Accordingly, even if a strong shock acts onto the front wheels 20, it is possible to prevent the steering rods 30 as well as the steering mechanism 32 from being damaged, thereby improving the reliability of the running toy.

Additionally, since the coil-shaped spring member 40 is formed by winding up a portion of the steering rods 30 in a coil-like form, it is possible, with this simple structure, to protect the steering rods 30 as well as the steering mechanism 32 from an excessive impact force acted onto the front wheels 20.

It should be noted that the present invention is not limited to the above embodiment, various modifications can be made within the spirit and scope of the invention.

As explained above, according to the remote control running toy of the present invention, the provision of the shock absorber for absorbing the impact force transmitted through the uprights to the steering rods offers a remote control running toy capable of preventing the steering rods, from being damaged by the shock, even if a strong shock acts onto the front wheels, thus improving the reliability of the running toy.

What is claimed is:

1. A remote control running toy, comprising:

a suspended chassis for supporting a car body thereon, a rear-wheel driving mechanism for running the chassis by driving a pair of right and left rear wheels fitted respectively at the right and left rear sides of the chassis;

a pair of uprights, each having a kingpin for steerably supporting a pair of right and left front wheels which are fitted respectively at the right and left front sides of the chassis; and a steering mechanism coupled through steering rods with the uprights;

wherein the running toy further comprises a shock absorber for absorbing a shock transmitted through the steering rods and wherein the shock absorber is a coil spring member formed by winding up a part of the steering rods in a coil form.

2. The remote control running toy according to claim 1, wherein the steering rods are respectively made of a metal wire.

* * * * *